US011475741B1

(12) United States Patent
Johnston

(10) Patent No.: US 11,475,741 B1
(45) Date of Patent: Oct. 18, 2022

(54) FRAUD DETECTION SYSTEM AND METHOD

(71) Applicant: NCR Corporation, Atlanta, GA (US)

(72) Inventor: Kevan D. Johnston, Stirling (GB)

(73) Assignee: NCR Corporation, Atlanta, GA (US)

( * ) Notice: Subject to any disclaimer, the term of this patent is extended or adjusted under 35 U.S.C. 154(b) by 0 days.

(21) Appl. No.: 17/378,948

(22) Filed: Jul. 19, 2021

(51) Int. Cl.
*G07F 19/00* (2006.01)

(52) U.S. Cl.
CPC ..... *G07F 19/2055* (2013.01); *G07F 19/207* (2013.01)

(58) Field of Classification Search
CPC ..... G07F 19/2055; G07F 7/0873
USPC ..... 235/379, 380, 451
See application file for complete search history.

(56) References Cited

U.S. PATENT DOCUMENTS 8,915,434 B2 12/2014 Mitchell et al.

FOREIGN PATENT DOCUMENTS

CN 102842014 A * 12/2012 ..... G07F 19/2055

* cited by examiner

*Primary Examiner* — Suezu Ellis
(74) *Attorney, Agent, or Firm* — Schwegman, Lundberg & Woessner

(57) ABSTRACT

A system and method for detecting a foreign object is disclosed. A transmit assembly has a transmit electrode, a ground plane, and a shield electrode positioned between the transmit electrode and the ground plane. Drive circuitry applies a predetermined fixed signal to the transmit electrode and to the shield electrode. A receive assembly is positioned adjacent to the transmit assembly and has a receive electrode. Detection circuitry is coupled to the receive electrode and generates a receive signal based the predetermined fixed signal applied to the transmit electrode. A controller monitors the receive signal to determine when a foreign object has been placed in proximity to the transmit assembly and/or the receive assembly.

20 Claims, 4 Drawing Sheets

FRAUD DETECTION SYSTEM AND METHOD

FIELD

This disclosure relates generally to an improved fraud detection system and method for use with equipment, such as self-service terminals like automatic teller machines and gas pumps, that read information from a debit or credit card.

BACKGROUND

Unauthorized reading of card data, such as data encoded on a magnetic stripe of a customer's debit or credit card, while the card is being used ("card skimming"), is a known type of fraud. Card skimming is most often done by adding a skimmer, i.e., an assembly including a separate magnetic read head, to the front fascia of a self-service terminal (e.g., an automated teller machine (ATM) or gas pump) which reads the magnetic stripe on the customer's card as the card is inserted or removed from the ATM or gas pump.

Current systems and methods for detecting skimmers are based on the use of a capacitive sensor. A ground plane is often used on the transmit electrode printed circuit board of the capacitive sensor in the self-service terminal in order to prevent the capacitive sensor from being triggered by movement behind the front fascia of the self-service terminal (e.g., movement inside an automatic teller machine). However, the ground plane can limit the skimmer detection distance in front of the front fascia and therefore limit the effectiveness of the sensor.

Accordingly, there is a need for an improved capacitive sensor which is not triggered by movement behind the front fascia of the associated self-service terminal and which has a better skimmer detection distance.

BRIEF DESCRIPTION OF THE DRAWINGS

The following detailed description, given by way of example and not intended to limit the present disclosure solely thereto, will best be understood in conjunction with the accompanying drawings in which.

DETAILED DESCRIPTION

In the present disclosure, like reference numbers refer to like elements throughout the drawings, which illustrate various exemplary embodiments of the present disclosure.

Capacitive sensor-based skimmer detection systems typically identify the presence of a skimmer by detecting a change in a projected electric field coupling between a transmit electrode and a receive electrode. When a skimmer or other object is positioned within the projected electric field, the dielectric value between the two capacitive electrodes changes and the signal received at the receive electrode (based on the signal applied to the transmit electrode) will change. The transmit electrode may include a ground plane on a rear portion thereof in order to reduce the system's sensitivity to movement behind the electrode (i.e., within the self-service terminal). A drawback is that the proximity of the ground plane to the transmit electrode reduces the magnitude of the projected electric field in the desired (forward) direction due to capacitive-based signal leakage from the transmit electrode to the ground plane. A typical arrangement for the transmit electrode is to use a double-sided printed circuit board with the transmit electrode shape formed on the top side thereof and the ground plane formed on the bottom side thereof, the ground plane formed in a shape that mirrors the transmit electrode shape.

In accordance with the present disclosure, the projected electric field is increased and shaped using an additional shield electrode between the transmit electrode and the ground plane in order to isolate the transmit electrode from the ground plane. The shield electrode is driven by a separate driver circuit but with the same signal as the transmit electrode. Because there is no voltage difference between the transmit electrode and the shield electrode and minimal capacitance between the transmit electrode and the shield electrode, the signal leakage due to any capacitive coupling on the printed circuit board is greatly reduced or even eliminated. Since the leakage to the ground plane is eliminated, this system and method provides a larger projected electric field in front of the transmit electrode without having to increase the signal strength on the transmit electrode.

Figure 1:
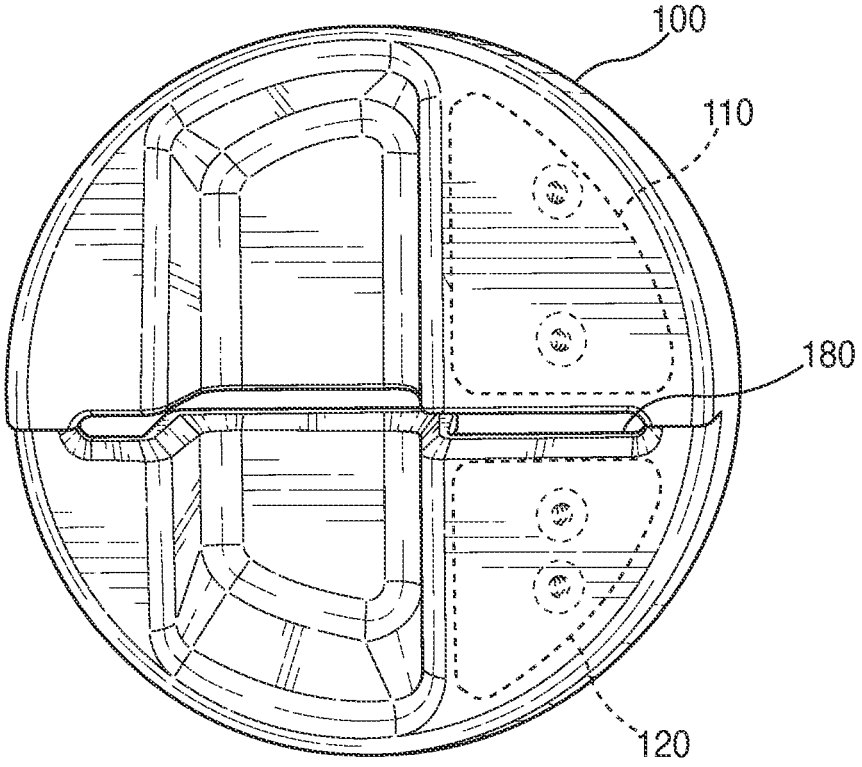
FIG. 1 is a front view of a card reader bezel for a self-service terminal.
Figure 2:
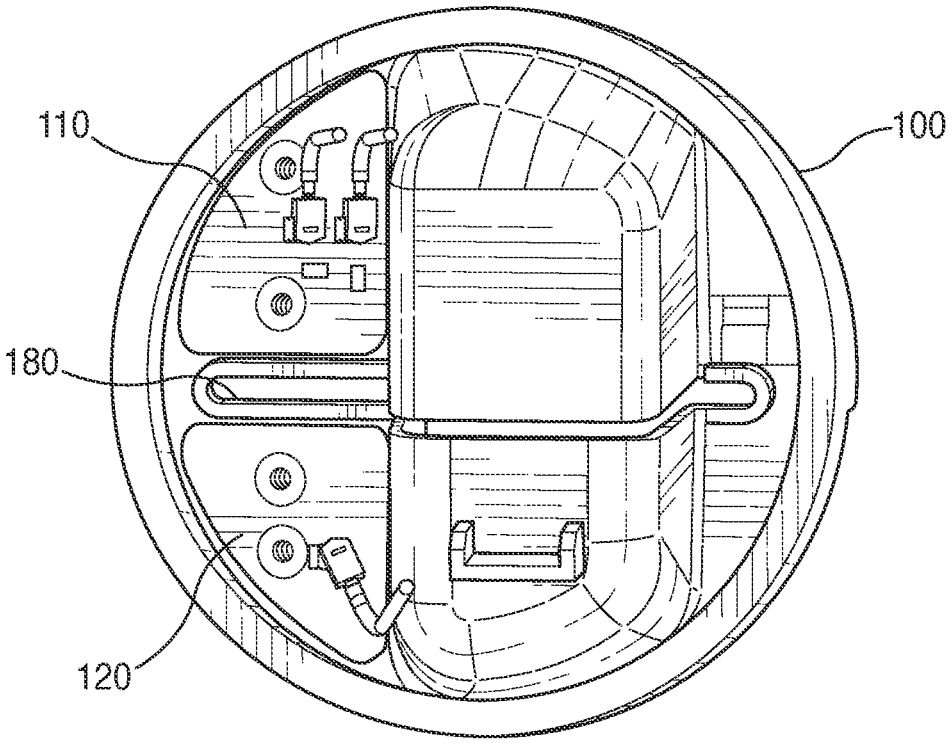
FIG. 2 is a rear view of the card reader bezel shown in FIG. 1.
Figure 6:
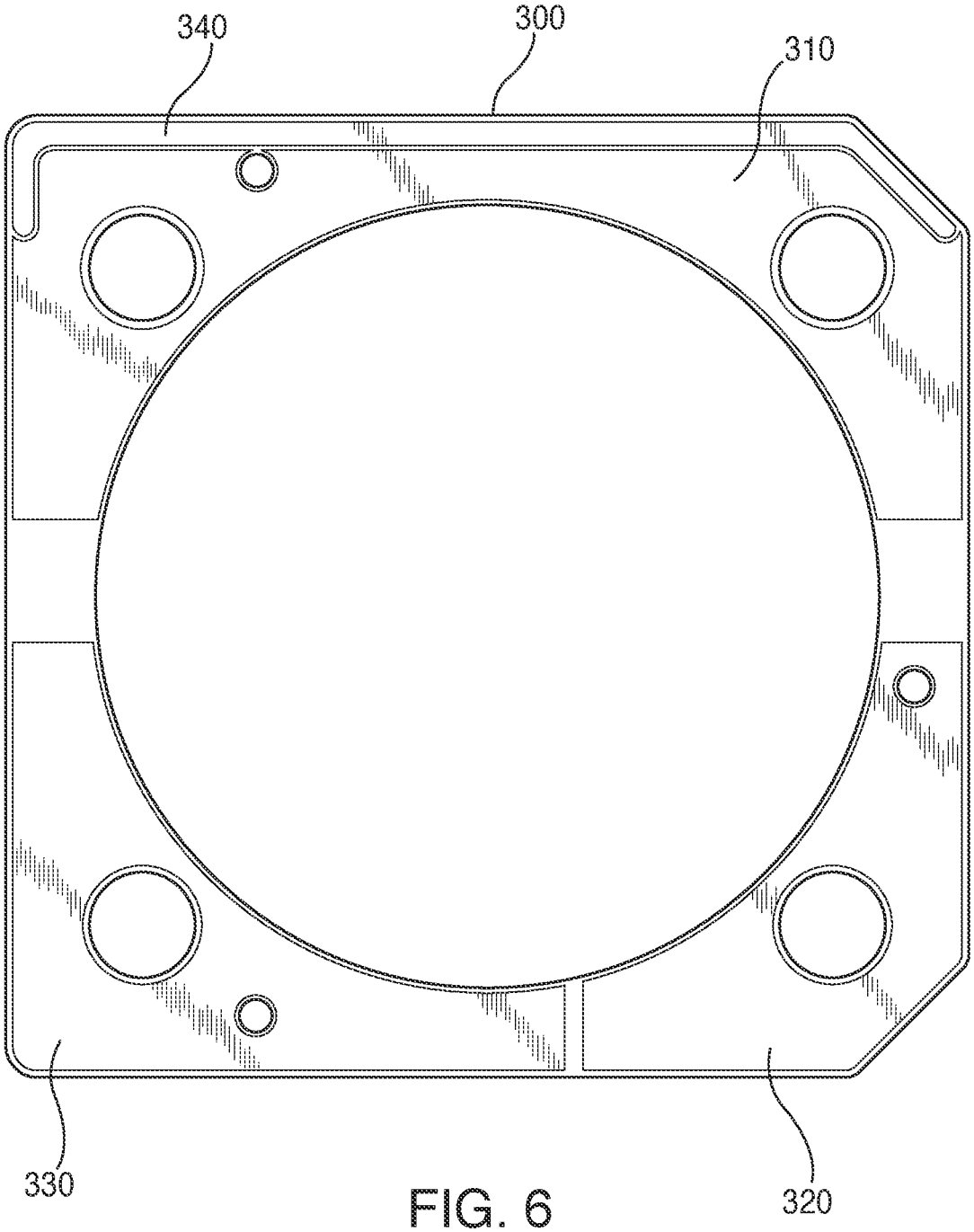
FIG. 6 is a diagram of an alternative printed circuit board for use with the capacitive sensor system and method of the present disclosure.

Referring now to FIGS. 1 and 2, a bezel 100 for a card reader for a self-service terminal is shown which includes a slot 180 for insertion of a debit or credit card. A transmit assembly 110 (e.g., a printed circuit board) is mounted above slot 180 on an inner surface of bezel 100. A receive assembly 120 (e.g., a printed circuit board) is mounted below slot 180 on an inner surface of bezel 100 in order to detect when a foreign object is placed in proximity to slot 180. Although the transmit assembly 110 and the receive assembly 120 are shown in two separate printed circuit boards in FIG. 1, as shown in FIG. 6 below, the transmit assembly 110 and the receive assembly 120 can both be placed on a single printed circuit board in some applications.

Figure 3:
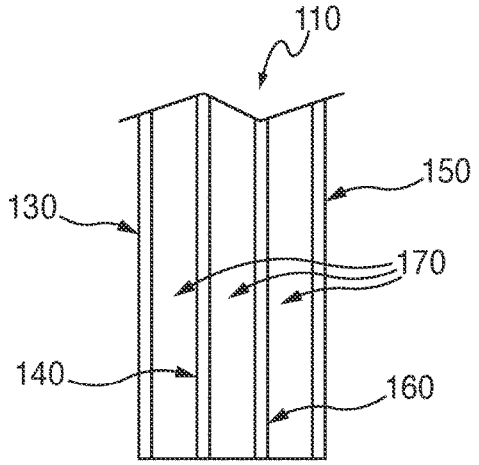
FIG. 3 is a cross-sectional view of a transmit electrode printed circuit board for use in the system and method of the present disclosure.

As shown in the cross-sectional view of FIG. 3, the transmit assembly 110 includes a top layer forming the transmit electrode 130, a first internal layer forming the shield electrode 140, a second internal layer 160, and a bottom layer forming the ground plane 150. The transmit assembly 110 is formed from an insulating material 170, with the first internal layer (transmit electrode 130) and the second internal layer 160 sandwiched between layers of insulating material. Printed circuit boards are typically formed with no internal layers (a two-layer board), with two internal layers (a four-layer board), or with more internal layers. For the system and method of the present disclosure, a four-layer board may be used, with second internal layer 160 having no metal traces placed thereon. In other embodiments, a three-layer board may be used, with second internal layer 160 completely omitted. The transmit electrode 130 is shown in FIG. 3 as part of a printed circuit board, but other similar types of assemblies may be used.

Figure 4:
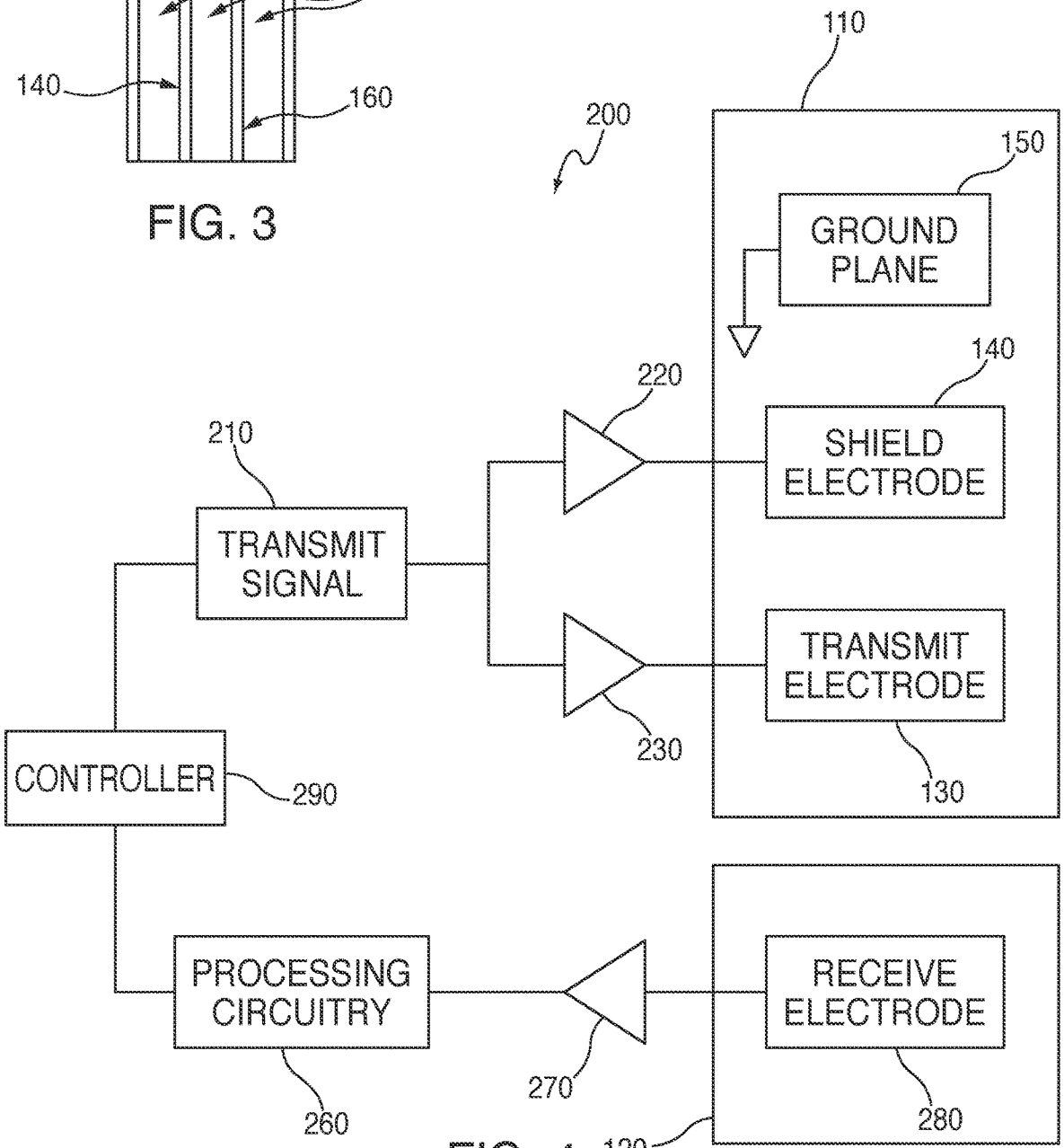
FIG. 4 is a block diagram of a capacitive sensor system according to the present disclosure.

Referring now to FIG. 4, a system 200 for detecting a skimmer placed over the card reader bezel for a self-service terminal includes a controller 290, a transmit signal generator 210, a first drive amplifier 230, a second drive amplifier 220, a ground plane 150, a shield electrode 140, a transmit electrode 130, a receive electrode 280, an amplifier 270, and processing circuitry 260. As shown, the ground plane 150, the shield electrode 140, and the transmit electrode 130 are all part of the transmit assembly 110. In operation, drive circuitry applies a predetermined fixed signal to the transmit electrode 130 and the shield electrode 140 and detection circuitry receives a return signal from the receive electrode 280 and processes the return signal to determine if a foreign object has been placed in proximity to the transmit electrode 130 and/or the receive electrode 280 (e.g., if the foreign object has been placed near the slot 180 when the transmit electrode 130 is directly above the slot 180 and the receive electrode 280 is directly below the slot 180). In particular, the transmit signal generator 210 generates the predetermined fixed signal which is amplified by the first drive amplifier 230 to be driven onto transmit electrode 130. The same generated predetermined fixed signal is amplified by the second drive amplifier 220 to be driven onto shield electrode 140. In some cases, a second separate transmit generator may be provided to supply a second fixed predetermined signal having the approximately same characteristics (e.g., magnitude and frequency) as the first fixed predetermined signal to the shield electrode 140. Because the shield electrode 140 is between the transmit electrode 130 and the ground plane 150, there will be no signal leakage from the transmit electrode 130 to the ground plane 150 and the electric field projected from transmit electrode will have a greater magnitude than when a shield electrode is not present (because of signal leakage to ground in the latter case). A signal appearing on receive electrode 280 (based on the signal from transmit electrode 130) is amplified by amplifier 270 and processed by processing circuitry 260 to generate an output signal. The output signal is generally constant while nothing is positioned near the slot 180 on bezel 100, but will change significantly when a foreign object, such as a skimmer, placed in or over slot 180. Controller 290 monitors the output signal and generates an alarm signal when the signal changes by an amount indicating that a foreign object has been placed in or over slot 180.

Figure 5:
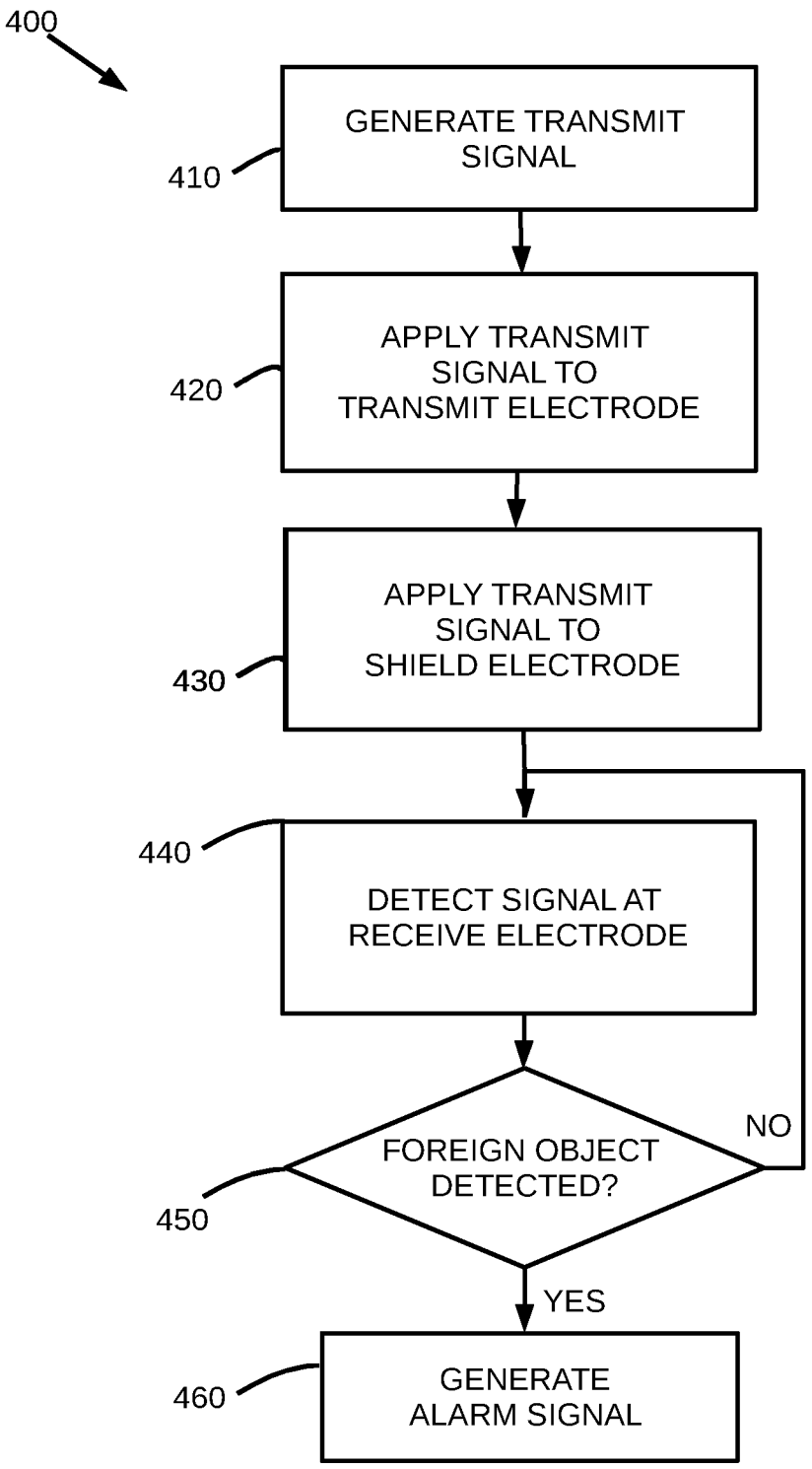
FIG. 5 is a flowchart of the capacitive sensor method according to the present disclosure.

Referring now to FIG. 5, a method for detecting a foreign object such as a skimmer placed over the card reader bezel for a self-service terminal is shown in a flowchart 400. First, at step 410, a transmit signal is generated. The transmit signal is applied to a transmit electrode at step 420, preferably via a first amplifier and is applied to a shield electrode at step 430, preferably via a second amplifier. The shield electrode is positioned between the transmit electrode and a ground plane in order to maximize the electric field projected in front of the transmit electrode. At step 440, any signal present at the receive electrode is detected and at step 450 the detected signal is examined to determine if it indicates that a foreign object is present over the associated card reader bezel. The detected signal will have a generally constant value and will only change when a foreign object is positioned over or on the card reader bezel. If no foreign object is detected, processing reverts to step 440. If a foreign object is detected, an alarm signal is generated at step 460.

A shield trace can also be used to shape the projected electric field from the transmit electrode. When placed adjacent to the transmit electrode, the shield trace will direct the electric field from the transit electrode in a direction away from the shield trace. As shown in FIG. 6, a printed circuit board 300 for installation on an internal surface of a card reader bezel for a self-service terminal includes a transmit electrode 310 and two receive electrodes 320, 330 on a top layer. Printed circuit board 300 also includes an internal layer forming a shield electrode in the same shape as transmit electrode 310 and a bottom layer with a ground plane formed in the same shape as the transmit electrode. The top layer of printed circuit board 300 also includes a shield trace 340 which is electrically connected to the internal shield electrode and, based on its position, reduces the level of the projected electric field in the area above shield trace 340.

Although the present disclosure has been particularly shown and described with reference to the preferred embodiments and various aspects thereof, it will be appreciated by those of ordinary skill in the art that various changes and modifications may be made without departing from the spirit and scope of the disclosure. It is intended that the appended claims be interpreted as including the embodiments described herein, the alternatives mentioned above, and all equivalents thereto.

What is claimed is:

1. A system for detecting a foreign object, comprising:
- a transmit assembly having a transmit electrode, a ground plane, and a shield electrode positioned between the transmit electrode and the ground plane;
- drive circuitry for applying a predetermined fixed signal to the transmit electrode and to the shield electrode;
- a receive assembly positioned adjacent to the transmit assembly and having a receive electrode; and
- detection circuitry coupled to the receive electrode for generating a receive signal based on a signal from the receive electrode corresponding to the predetermined fixed signal applied to the transmit electrode and for monitoring the receive signal to determine when a foreign object has been placed in proximity to the transmit assembly and/or the receive assembly.

2. The system of claim 1, wherein the transmit assembly comprises a printed circuit board having a first outer layer on a first side, a second outer layer on a second side opposite the first side, and an inner layer between the first outer layer and the second outer layer, the first outer layer forming the transmit electrode, the second outer layer forming the ground plane, and the inner layer forming the shield electrode.

3. The system of claim 1, wherein the drive circuitry comprises:
- a transmit signal generator for generating the predetermined fixed signal;
- a first drive amplifier coupled between the transmit signal generator and the transmit electrode for applying the predetermined fixed signal to the transmit electrode; and
- a second drive amplifier coupled between the transmit signal generator and the shield electrode for applying the predetermined fixed signal to the shield electrode.

4. The system of claim 1, wherein the detection circuitry comprises:
- an amplifier having an input coupled to the receive electrode and an output, the amplifier providing an amplified version of the signal from the receive electrode; and
- processing circuitry coupled to the output of the amplifier, the processing circuitry for processing the amplified version of the signal from the receive electrode to create the receive signal; and
- a controller that monitors the receive signal to determine when a foreign object has been placed in proximity to the transmit assembly and/or the receive assembly.

5. The system of claim 4, wherein the controller determines that the foreign object has been placed in proximity to the transmit assembly and/or the receive assembly when the receive signal changes by a predetermined amount.

6. A system for detecting a foreign object, comprising:

a transmit assembly having a transmit electrode, a ground plane, and a shield electrode positioned between the transmit electrode and the ground plane;

drive circuitry for applying a first predetermined fixed signal to the transmit electrode and a second predetermined fixed signal to the shield electrode, the second predetermined fixed signal having an approximately same magnitude and an approximately same frequency as the first predetermined fixed signal;

a receive assembly positioned adjacent to the transmit assembly and having a receive electrode; and detection circuitry coupled to the receive electrode for generating a receive signal based on a signal from the receive electrode corresponding to the first predetermined fixed signal applied to the transmit electrode and for monitoring the receive signal to determine when a foreign object has been placed in proximity to the transmit assembly and/or the receive assembly.

7. The system of claim 6, wherein the transmit assembly comprises a printed circuit board having a first outer layer on a first side, a second outer layer on a second side opposite the first side, and an inner layer between the first outer layer and the second outer layer, the first outer layer forming the transmit electrode, the second outer layer forming the ground plane, and the inner layer forming the shield electrode.

8. The system of claim 7, wherein the drive circuitry comprises:

a first transmit signal generator for generating the first predetermined fixed signal;

a first drive amplifier coupled between the first transmit signal generator and the transmit electrode for applying the first predetermined fixed signal to the transmit electrode;

a second transmit signal generator for generating the second predetermined fixed signal; and a second drive amplifier coupled between the second transmit signal generator and the shield electrode for applying the second predetermined fixed signal to the shield electrode.

9. The system of claim 6, wherein the detection circuitry comprises:

an amplifier having an input coupled to the receive electrode and an output, the amplifier providing an amplified version of the signal from the receive electrode; and processing circuitry coupled to the output of the amplifier, the processing circuitry for processing the amplified version of the signal from the receive electrode to create the receive signal; and a controller that monitors the receive signal to determine when a foreign object has been placed in proximity to the transmit assembly and/or the receive assembly.

10. The system of claim 9, wherein the controller determines that the foreign object has been placed in proximity to the transmit assembly and/or the receive assembly when the receive signal changes by a predetermined amount.

11. A system for detecting a foreign object, comprising:

a transmit assembly having a transmit electrode, a ground plane, a shield electrode positioned between the transmit electrode and the ground plane, and a shield trace positioned in a same plane as the transmit electrode, the shield trace positioned in order to direct an electric field created by the transmit electrode away from the shield trace;

drive circuitry for applying a predetermined fixed signal to the transmit electrode and to the shield electrode;

a receive assembly positioned adjacent to the transmit assembly and having a receive electrode; and detection circuitry coupled to the receive electrode for generating a receive signal based on a signal from the receive electrode corresponding to the predetermined fixed signal applied to the transmit electrode and for monitoring the receive signal to determine when a foreign object has been placed in proximity to the transmit assembly and/or the receive assembly.

12. The system of claim 11, wherein the transmit assembly comprises a printed circuit board having a first outer layer on a first side, a second outer layer on a second side opposite the first side, and an inner layer between the first outer layer and the second outer layer, the first outer layer forming the transmit electrode, the second outer layer forming the ground plane, and the inner layer forming the shield electrode.

13. The system of claim 11, wherein the drive circuitry comprises:

a transmit signal generator for generating the predetermined fixed signal;

a first drive amplifier coupled between the transmit signal generator and the transmit electrode for applying the predetermined fixed signal to the transmit electrode; and a second drive amplifier coupled between the transmit signal generator and the shield electrode for applying the predetermined fixed signal to the shield electrode.

14. The system of claim 11, wherein the detection circuitry comprises:

an amplifier having an input coupled to the receive electrode and an output, the amplifier providing an amplified version of the signal from the receive electrode; and processing circuitry coupled to the output of the amplifier, the processing circuitry for processing the amplified version of the signal from the receive electrode to create the receive signal; and a controller that monitors the receive signal to determine when a foreign object has been placed in proximity to the transmit assembly and/or the receive assembly.

15. The system of claim 14, wherein the controller determines that the foreign object has been placed in proximity to the transmit assembly and/or the receive assembly when the receive signal changes by a predetermined amount.

16. A method for detecting a foreign object, comprising:

applying a predetermined fixed signal to a transmit electrode and to a shield electrode, the transmit electrode and the shield electrode being part of a transmit assembly, the shield electrode positioned between the transmit electrode and a ground plane on the transmit assembly;

generating a receive signal based on a signal from a receive electrode on a receive assembly positioned adjacent to the transmit assembly, the signal from the receive electrode corresponding to the predetermined fixed signal applied to the transmit electrode; and monitoring the receive signal to determine when a foreign object has been placed in proximity to the transmit assembly and/or the receive assembly.

17. The method of claim 16, wherein the transmit assembly comprises a printed circuit board having a first outer layer on a first side, a second outer layer on a second side opposite the first side, and an inner layer between the first outer layer and the second outer layer, the first outer layer forming the transmit electrode, the second outer layer forming the ground plane, and the inner layer forming the shield electrode.

18. The method of claim 16, wherein the predetermined fixed signal is generated by a transmit signal generator and is applied to the transmit electrode by a first drive amplifier coupled between the transmit signal generator and the transmit electrode.

19. The method of claim 16, wherein the predetermined fixed signal is generated by a transmit signal generator and is applied to the shield electrode by a second drive amplifier coupled between the transmit signal generator and the shield electrode.

20. The method of claim 16, wherein the monitoring step determines that the foreign object has been placed in proximity to the transmit assembly and/or the receive assembly when the receive signal changes by a predetermined amount.

* * * * *